US009297552B2

(12) United States Patent
Noman et al.

(10) Patent No.: US 9,297,552 B2
(45) Date of Patent: Mar. 29, 2016

(54) VELOCITY ZONING HEAT EXCHANGER AIR BAFFLE

(71) Applicant: LENNOX INDUSTRIES INC., Richardson, TX (US)

(72) Inventors: Shiblee S. M. Noman, Carrollton, TX (US); Ian Burmania, Carrollton, TX (US)

(73) Assignee: Lennox Industries Inc., Richardson, TX (US)

( * ) Notice: Subject to any disclaimer, the term of this patent is extended or adjusted under 35 U.S.C. 154(b) by 519 days.

(21) Appl. No.: 13/710,562

(22) Filed: Dec. 11, 2012

(65) Prior Publication Data

US 2014/0158115 A1 Jun. 12, 2014

(51) Int. Cl.

| | |
|---|---|
| ***F24H 3/06*** | (2006.01) |
| ***F24H 9/00*** | (2006.01) |
| ***F24H 3/10*** | (2006.01) |
| ***F28F 3/12*** | (2006.01) |
| ***F28D 1/03*** | (2006.01) |

(52) U.S. Cl.

CPC ..... *F24H 9/0063* (2013.01); *F24H 3/105* (2013.01); *F24H 9/0068* (2013.01); *F28D 1/035* (2013.01); *F28D 1/0316* (2013.01); *F28F 3/12* (2013.01); *Y10T 29/49826* (2015.01)

(58) Field of Classification Search

CPC ..... F24H 3/105; F24H 9/0063; F24H 8/00; F24H 3/087; F24H 9/0073

USPC ..... 126/99 D, 99 R, 110 R, 116 R, 112, 170, 126/159

See application file for complete search history.

(56) References Cited

U.S. PATENT DOCUMENTS

| | | | | |
|---|---|---|---|---|
| 6,564,794 | B1 * | 5/2003 | Zia et al. | 126/110 R |
| 2011/0174291 | A1 * | 7/2011 | Manohar et al. | 126/112 |

* cited by examiner

*Primary Examiner* — Jorge Pereiro

(74) *Attorney, Agent, or Firm* — R. Johnston Law, PLLC

(57) ABSTRACT

One aspect of this disclosure provides a zoning baffle for a gas furnace. This embodiment comprises a housing, a primary heating zone located in the housing and comprising one or more heating chambers. A blower having an exhaust opening is located adjacent the primary heating zone and is positioned to force air through the primary heating zone. A zoning baffle is located between the blower and the primary heating zone. The zoning baffle comprises spaced apart baffles oriented substantially parallel with the one or more heating chambers. A method of manufacturing a gas furnace is also provided.

17 Claims, 4 Drawing Sheets

VELOCITY ZONING HEAT EXCHANGER AIR BAFFLE

TECHNICAL FIELD

This application is directed, in general, to heating, ventilation and air conditioning (HVAC) systems and, more specifically, to a high-efficiency furnace having a velocity zoning heat exchanger air baffle.

BACKGROUND

A conventional high-efficiency furnace typically employs several heat exchangers to warm an air stream passing through the furnace. A high-efficiency furnace is one where approximately 90% of the energy put into the furnace is converted into heat for the purposes of heating the targeted space. These high-efficiency furnaces include "clamshell" or individual panel halves formed by stamping mirror images of the combustion chambers into corresponding metal sheets and coupling them together. Often high-efficiency furnaces comprise a primary heating chamber that includes the clamshell heat exchangers or heating chambers and they often include a secondary heat exchanger/condenser. The air passes through the secondary heat exchanger/condenser from a blower or fan and then passes through the primary heat exchanger. High-efficiency furnaces are also characterized by high operating temperatures, which consistently exceed 1000 degrees. As a result, hot spots can occur at certain points in the passageway of the clam shell heat exchanger. The high operating temperatures that create these hot spots can create cracking problems in the clamshell heat exchanger panels. When such cracks appear, their occurrence is considered a failure of the system.

SUMMARY

One aspect of this disclosure provides a zoning baffle for a high-efficiency gas furnace. This embodiment comprises a housing, a primary heating zone located in the housing and comprising one or more heating chambers. A blower having an exhaust opening is located adjacent the primary heating zone and is positioned to force air through the primary heating zone. A zoning baffle is located between the blower and the primary heating zone. The zoning baffle comprises spaced apart baffles oriented substantially parallel with the one or more heating chambers.

A method of fabricating a high-efficiency furnace is also provided. One method embodiment comprises providing a housing, placing one or more heating chambers in the housing to form a primary heating zone, placing a blower having an exhaust opening within the housing and adjacent the primary heating zone and positioned to force air through the primary heating zone, and placing a zoning baffle between the blower and the primary heating zone. The zoning baffle comprises spaced apart baffles oriented substantially parallel with one or more of the heating chambers.

BRIEF DESCRIPTION

Reference is now made to the following descriptions taken in conjunction with the accompanying drawings, in which.

DETAILED DESCRIPTION

Figure 1:
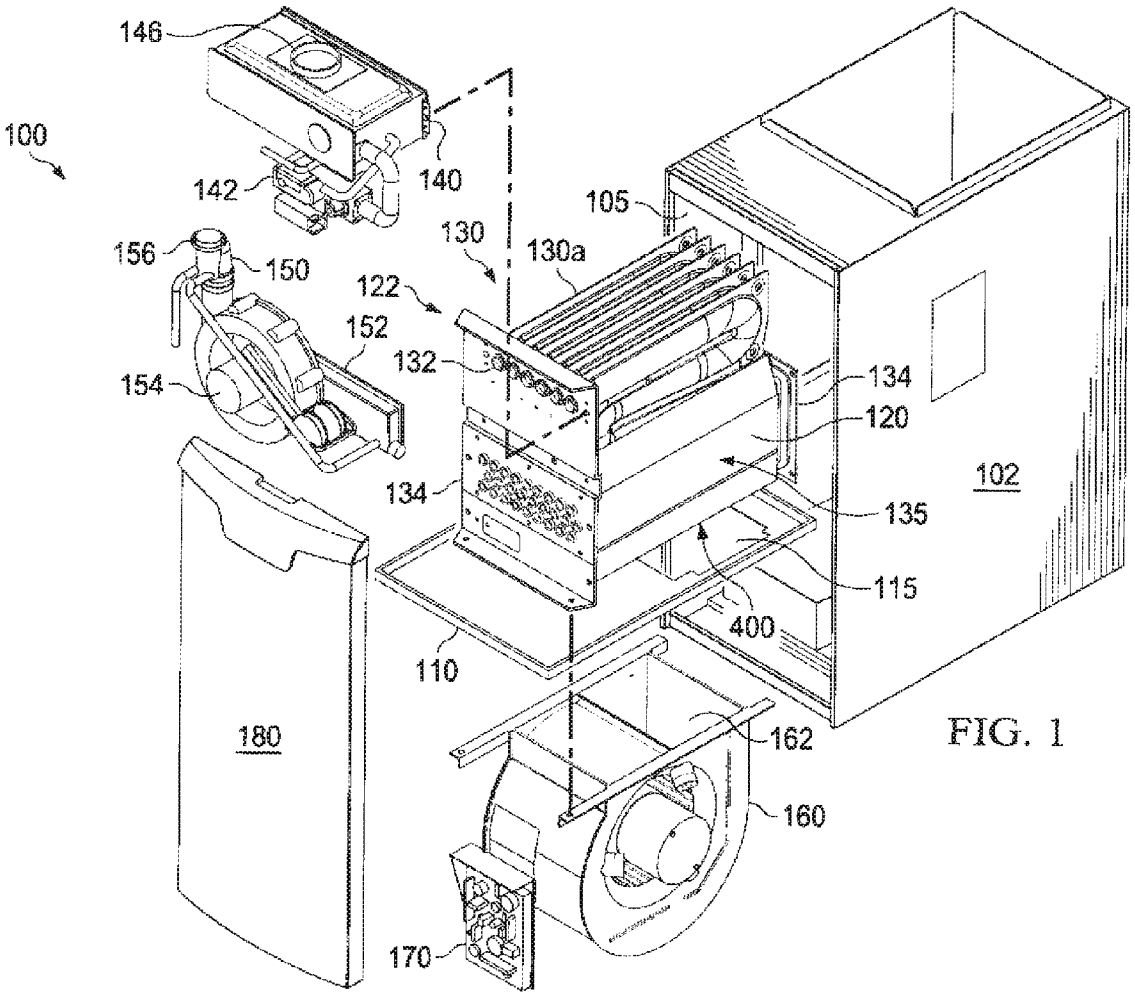
FIG. 1 illustrates an exploded isometric view of a portion of one embodiment of a furnace within which the zoning baffle may be employed.

Described herein are various embodiments of a zoning baffle that may be employed in a gas furnace. In one embodiment, the zoning baffle is designed to be placed within a primary heating zone of a furnace that comprises one or more heating chambers and between the primary heating zone and the blower, where it increases the air velocity and guides the air to one or more known hot spots located on one or more of the heating chambers. The purpose of the zoning baffle, as provided herein, is to reduce the temperature at the hot spots associated with each heating chamber without detrimentally increasing cubic feet per minute (CFM) airflow of the furnace, or without increasing the wattage requirements of the blower motor.

The heating chambers of current high-efficiency gas furnaces have higher surface temperatures at maximum leaving air conditions, which is typically more than 1000° F. At this temperature, a low strength steel (extra deep drawing steel known as EDDS), which is the material of choice for many manufactures, will not survive the required reliability tests. To circumvent these problems, some manufactures turn to more expensive materials or tolerate a shorter operational life of the furnace.

To use EDDS material in current high-efficiency furnace designs, it is necessary to reduce the surface temperatures of the heating chambers. Embodiments of the zoning baffle, as presented herein, have been found to lower the temperatures of the heating chambers to about 926° F., which is enough of a drop to significantly increase the life of the heating chambers, even when using EDDS materials. Certain embodiments of the zoning baffle also split or create various velocity zones and reduce the turbulence within the furnace and delivers more air to the hot spots.

Additionally, the zoning baffle can be positioned such that the higher velocity air can be directed through the maximum number of condensing coils or tubes and the lower velocity air can be directed through the minimum number of condensing coils or tubes. Within these zones, air can be redirected to known hot spots on the heating chambers without affecting airflow in the other zones. Thus, embodiments of the zoning baffles, as presented herein, increase heat transfer in the secondary or heat exchanger/condenser, which increases the annual fuel utilization efficiency (AFUE) rating of the unit. The embodiments of the zoning baffle, as presented herein, may increase AFUE up to 0.60 percent, which improves secondary tube reduction in the heat exchanger/condenser. Further, the zoning baffle sits substantially parallel to the flow velocity coming from the main blower, so it does not increase any blower watt consumption.

Additionally, it has been recognized that the gap between the fin stock of the secondary or heat exchanger/condenser and the zoning baffle improves the furnaces AFUE performance. For example, an improvement was shown for gaps ranging from about 0.125 to about 1.00 inches, with better results being obtained for a gap of about 0.50 inches. Further, the components of the zoning baffle can also be oriented in an angular position with respect to the heating chambers. Improvements were observed in angular positions that range from 0 degrees to about 25 degrees.

In general, the various embodiments of the zoning baffle provides airflow to one or more known hot spots by providing one or more high air velocity zones and a surface along which airflow travels, thereby effectively guiding the airflow to the desired area on the heating chamber and at higher velocities. Without being limited by any theory of operation, it is believed that the airflow guidance is based on the coanda effect, wherein the fluid airflow is attracted to the flat surfaces of the zoning baffle. The guidance of the airflow causes the air to be directed more toward hot spots of the heating chambers, thereby reducing the temperature of the heating chambers and keeping their operating temperature within design parameters, which prevents premature stress and cracking in the area of the hot spot, even with EDDS type materials are used. This advantage allows manufacturers to use the cheaper construction materials without sacrificing operation life, while at the same time reducing manufacturing costs.

Though the zoning baffle, as presented herein, could be used in any furnace chamber, it provides particular benefits when employed in high-efficiency furnaces where 90% of the total amount of fuel used is converted directly into heat. The benefits arise from the fact that these high-efficiency furnaces reach higher operational temperatures, which causes the heating chambers to prematurely stress and crack at the above-mentioned hot spots. As stated above, the zoning baffle guides more airflow at high air velocities to these hot spots, which reduces stress and premature cracking in the heating chambers.

FIG. 1 is an exploded isometric view of a portion of one embodiment of a high-efficiency furnace 100 within which embodiments of the zoning baffle, as presented herein, may be employed. The furnace includes a housing 102 having a front opening 105 within which a mounting shelf 110 is located. The mounting shelf 110 has an opening 115 therein and supports a heat exchanger assembly 120 over the opening 115. The illustrated embodiment of the heat exchanger assembly 120 has a primary heating zone 130 that includes a row of six heating chambers (one referenced as 130*a*) coupled to an inlet panel 122. Alternative embodiments of the heat exchanger assembly 120 have more or fewer heating chambers 130*a* coupled to the inlet panel 122 in one or more rows. In the illustrated embodiment, the heating chambers 130*a* form the primary heating zone 130 and are generally serpentine and have two approximately 180° folds such that the heating chambers 130*a* cross over the opening 115 at least three times, terminating in inlets 132 and outlets 134 that are generally mutually coplanar and oriented toward the opening 105 of the housing 100. In certain embodiments, the heat exchanger assembly 120 may further include a conventional secondary heat exchanger zone 135 that is a heat exchanger/condenser.

A burner assembly 140 contains a thermostatically-controlled solenoid valve 142, a manifold 144 leading from the valve 142 and across the burner assembly 150, one or more gas orifices (not shown) coupled to the manifold 144 and one or more burners (not shown) corresponding to and located proximate the gas orifices. The illustrated embodiment of the burner assembly 140 has a row of six burners. Alternative embodiments of the burner assembly 140 have more or fewer burners arranged in one or more rows. A flue 146 allows undesired gases (e.g., unburned fuel) to be vented from the burner assembly 140. In an assembled configuration, the burner assembly 140 is located proximate the heat exchanger assembly 120 such that the burners thereof at least approximately align with the inlets 132.

A draft inducer assembly 150 contains a manifold 152, a draft inducing exhaust fan 154 having an inlet coupled to the manifold 152 and a flue 156 coupled to an outlet of the exhaust fan 154. In an assembled configuration, the draft inducer assembly 150 is located proximate the heat exchanger assembly 120, such that the manifold 152 thereof at least approximately aligns with the outlets 134 and the flue 156 at least approximately aligns with the flue 146 of the burner assembly 140.

A blower 160 is suspended from the shelf 110 such that an outlet 162 thereof approximately aligns with the opening 115. An electronic controller 170 is located proximate the blower 160 and, in the illustrated embodiment, controls the blower, the valve 142 and the exhaust fan 154 to cause the furnace to provide heat. A cover 180 may be placed over the front opening 105 of the housing 100.

In the illustrated embodiment, the controller 170 turns on the exhaust fan to initiate a draft in the heat exchangers (including the primary heating zone 130) and purge potentially harmful unburned gases or gaseous combustion products. Then the controller 170 opens the valve 142 to admit gas to the manifold 144 and the one or more gas orifices, whereupon the gas begins to mix with air to form primary combustion air. Then the controller 170 activates an igniter (not shown in FIG. 1) to attempt to ignite the primary combustion air. If the output of a thermocouple indicates that the primary combustion air has not ignited within a predetermined period of time, the controller 170 then closes the valve 142 and waits until attempting to start again. If the output of a thermocouple indicates that the primary combustion air has ignited within the predetermined period of time, the controller 170 then activates the blower, which forces air upward through the opening 115 and the heat exchanger assembly 120. As it passes over the surfaces of the heat exchangers, the air is warmed, whereupon it may be delivered or distributed as needed to provide heating.

Figure 2:
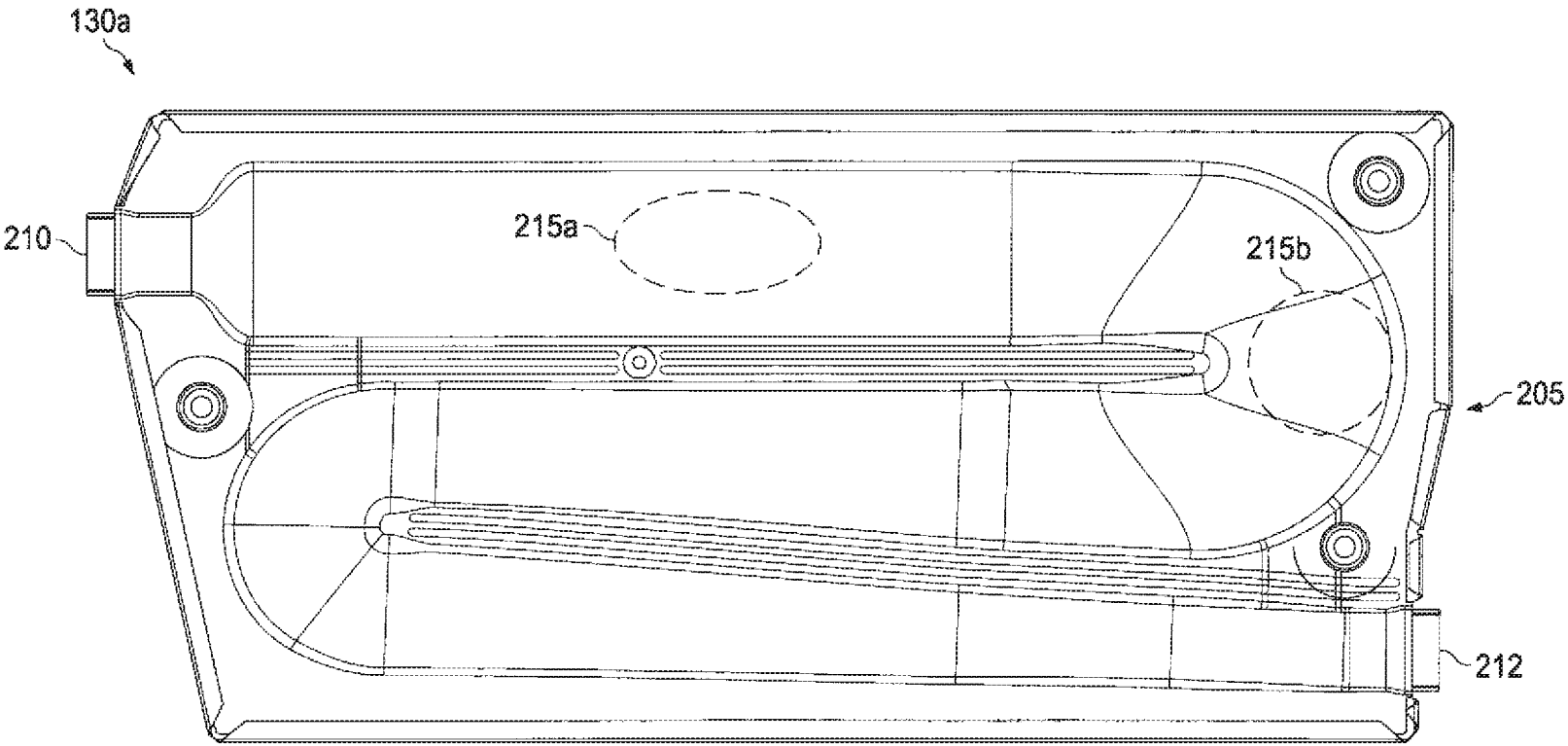
FIG. 2 illustrates a high-efficiency heating chamber used in the furnace of FIG. 1.

FIG. 2 illustrates an embodiment of one of the high-efficiency heating chambers 130*a*, as referenced above. The heating chamber 130*a* may be a clamshell design wherein mirrored halves are joined together in a conventional manner to form a heating chamber panel. Typically, the two mirrored halves are joined by one half overlapping the edge of the other and being crimped together or joined in another conventional manner. The heating chamber 130*a* has a backend 205 adjacent an outlet end 212 (exhaust end). Ignited gas enters the heating chamber 130*a* at an inlet end 210 and traverses the chamber pathway and exits the heating chamber 130*a* at outlet end 212. Due to the high-efficiency characteristics of the heating chamber 130*a*, hot spots 215*a*, 215*b* can develop during the operation of the furnace, and which overtime, can fatigue the metal and cause it to crack. The location of the hot spots 215*a*, 215*b* can be determined by obtaining readings from a thermocouple placed on the heating chamber 130*a*. As noted above, in conventional designs, to extend the life of the heating chamber 130*a*, manufacturers have fabricated the heating chambers from a more expensive sheet material to prevent premature cracking and failure of the heating chamber 130*a*. However, when used with the embodiments of the zoning baffle, as described herein, the above-mentioned EDDS material can be used, thereby reducing manufacturing costs, while maintaining a high quality operational life of the heat chamber 130*a*.

Figure 3:
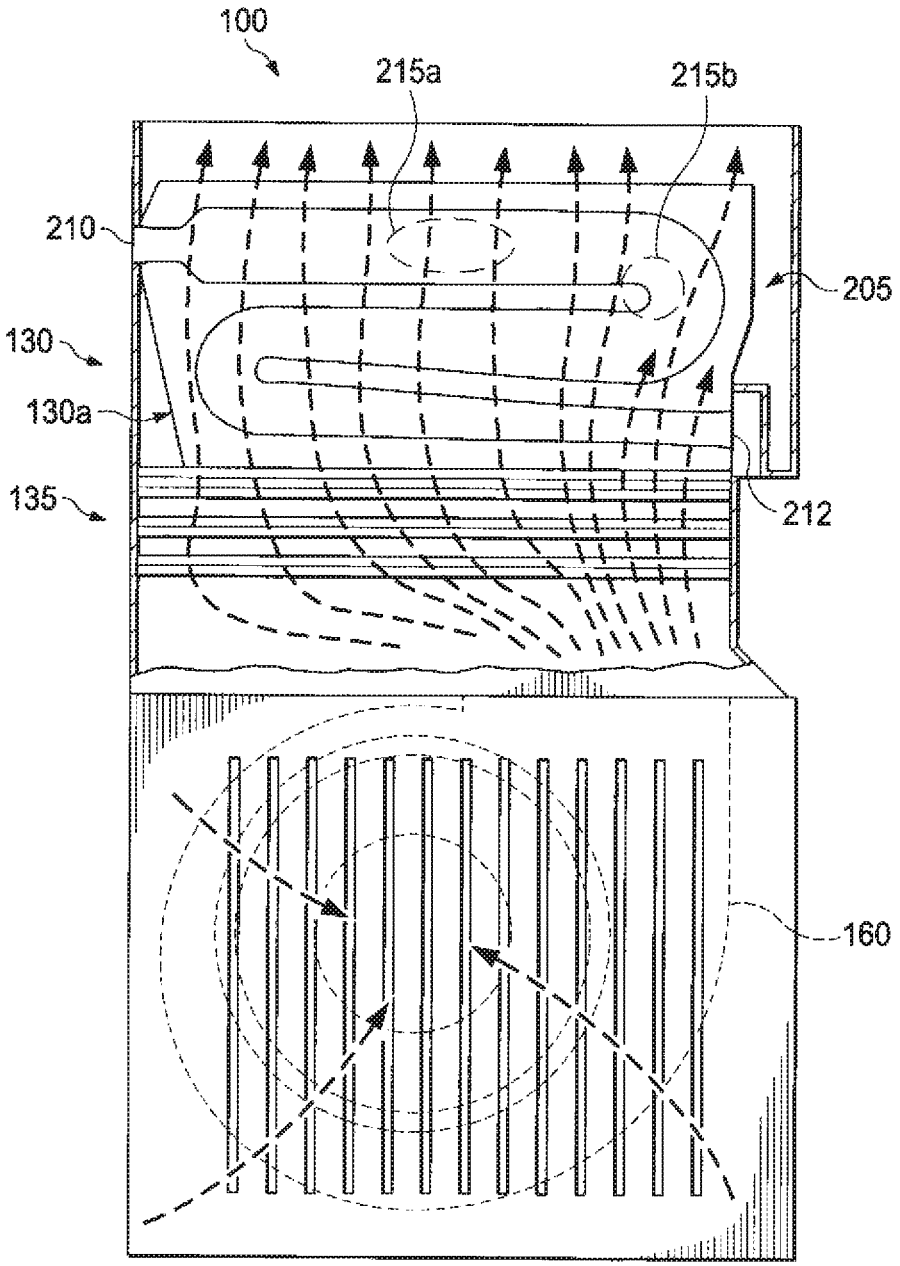
FIG. 3 illustrates a CFD analysis showing the airflow path lines through a primary heating chamber of the furnace of FIG. 1.

FIG. 3 is a CFD analysis showing the velocity of the airflow through the primary heating zone 130. The air leaves the blower at a high velocity of about 1500 feet per minute.

However, by the time the air passes through the secondary heating/condensing zone 135 and enters the primary heating zone 130, the velocity of the air significantly decreases to about 500 feet per minute, and in some areas of the primary heating zone 130, the air velocity can decrease to about 300 feet per minute. As a result, the temperature of the heating chambers 130*a* can increase to temperatures as much as 1000° F. However, as explained below, the presence of embodiments of the zoning baffle creates higher velocity zones in the primary heating zone chamber 130 and also guides more air to the hot spots 215*a*, 215*b*, thereby providing additional heat dissipation, which in turn, reduces the stress and premature cracking associated with its operation and extends the life of the heating chamber 130*a*.

Figure 4:
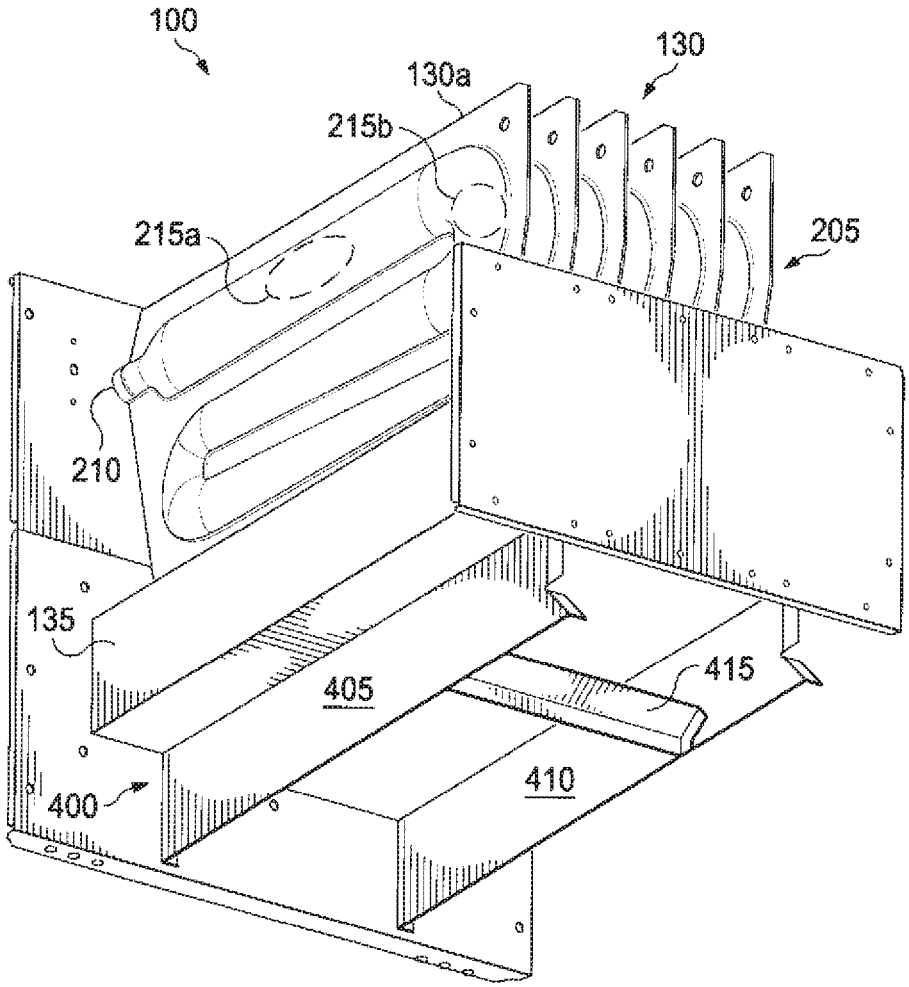
FIG. 4 illustrates one embodiment of the zoning baffle as used with heating chambers within a primary heating zone of a high-efficiency gas furnace.

FIG. 4 illustrates one embodiment of the zoning baffle 400. This embodiment is comprised of spaced apart baffles 405, 410 oriented substantially parallel with one or more of the heating chambers 130*a*, as shown. The heating chambers 130*a* are spaced apart such that an air flow generated by the blower 160 will pass between the heating chambers 130*a*. The distance that the baffles 405, 410 are spaced apart will depend on the determination of the hot spots on the heating chambers 130*a*. For example, if the hot spots are located more within the inner portion of the primary heating zone 130, the baffles 405, 410 will be positioned so that a higher velocity zone is created about those particular heating chambers 130*a*. If a greater number of heating chambers 130*a* also have hot spots, the spacing between the baffles 405, 410 will be greater to include those additional heating chambers 130*a*.

In one embodiment, the zoning baffle 400 is positioned between the blower 160 and the primary heating zone 130. (See FIG. 1). However, in an alternative embodiment, the zoning baffle 400 is positioned between the blower 160 and the conventional secondary heat exchanger/condenser zone 135 (See FIG. 1). In one aspect of this embodiment, the baffles 405, 410 may deviate from a true parallel or vertical position with respect to the heating chambers 130*a*. For example, the angle of orientation of the baffles 405, 410 may range from 0 degrees to about 25 degrees and still be considered to be substantially parallel with the heating chambers 130*a*, as that phrase is used herein and in the claims. In one embodiment, the baffles 405, 410 are substantially smooth, planar panels, allowing for manufacturing variances that provide a surface along which the air from blower 160 may flow. This results in a zoning effect that more efficiently directs the air to hot spots within the primary heating zone 130. Improvement was shown in the temperature reduction of the heating chambers 130*a* when the baffles 405, 410 were oriented within the above-noted range. However, a 0 degree orientation was found to give better results in temperature reduction of the heating chambers 130*a* than other orientations.

In another aspect, the zoning baffle 400 further includes a cross baffle 415 that extends between the baffles 405, 410. In one embodiment, the cross baffle 415 comprises an elongated plate that is bent to form opposing plates having an angle of separation between and extends perpendicularly between the baffles 405, 410. The cross baffle 415 may be rotated from a horizontal position by 0 degrees to about 45 degrees, with about degrees giving better results than other orientations. Additionally, as with the baffles 405, 410, the location of the cross baffle 415 within the primary heating zone 130 will depend on the location of the hot spots that are positioned more toward the back end 205 of the heating chambers 130*a*. In one embodiment, the cross baffle 415 creates a higher velocity zone than is created by the baffles 405, 410. The high velocity provides greater air flow through that portion of the primary heating zone 130, thereby reducing the occurrence of hot spots that cause premature cracking.

Figure 5:
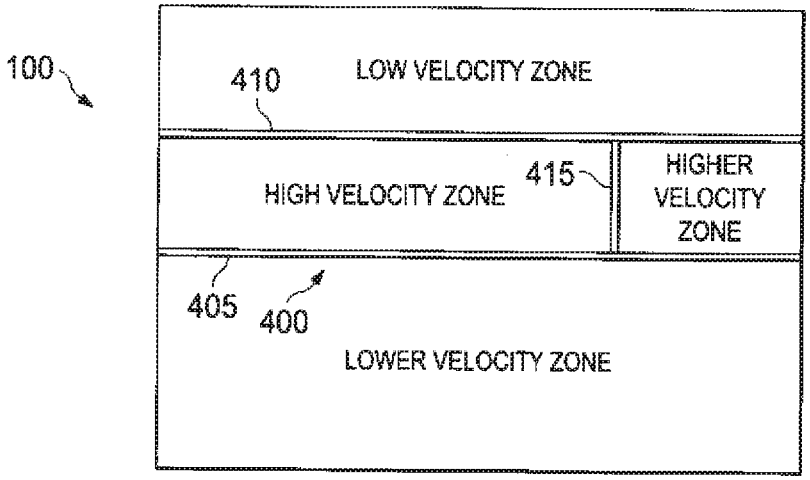
FIG. 5 illustrates an embodiment of the velocity zones created by the presence of the embodiments of the zoning baffle, as provided herein.

FIG. 5 illustrates an overhead view of the primary heating chamber 130 in which the zoning baffle 400 is implemented. As seen in this view, the zoning baffle 400, which in this embodiment includes the cross baffle 415, creates the various velocity zones as indicated in FIG. 5. The high and higher velocity zones are zones where air flow velocity is increased due to the presence of the zoning baffle 400. This along with the baffles 405, 410 and cross baffle 415 directs more air to known hot spot areas, which provides the above-discussed advantages.

With reference to FIGS. 1-5, in one embodiment of a methodology of fabrication of a high-efficiency gas furnace, there is provided a method of fabricating a high-efficiency gas furnace 100. This embodiment comprises providing a housing 102, placing a primary heating zone 130 within the housing 100 that includes spaced apart heating chambers 130*a*, wherein each of the heating chambers 130*a* has one or more pre-determined hot spots 215*a*, 215*b* associated therewith, and located adjacent an outlet end 212 of each of the heating chambers 130*a*. The method further comprises placing a blower 160 having an exhaust opening 162 within the housing 100 and adjacent the primary heating zone 130 and positioned to force air through the primary heating zone 130. A zoning baffle 400 is positioned between the blower and the primary heating zone 130. The zoning baffle comprises spaced apart baffles 405, 410 oriented substantially parallel with one or more of the heating chambers 130*a*, and in one application, the baffles 405, 410 are separated by a distance that is less than a width of the exhaust opening 162.

In one embodiment, an angle of orientation of the baffles 405, 410 from the substantially parallel or vertical orientation with respect to the heating chambers 130*a* ranges from 0 degrees to about 25 degrees. In another embodiment, the step of placing a zoning baffle further comprises placing a cross baffle 415 between the baffles 405, 410 and that extends between the baffles 405, 410. In one aspect of this embodiment, the cross baffle 415 comprises an elongated plate that is bent to form opposing plates having an angle of separation between. In another aspect, zoning baffles 405, 410, 415 create a first air velocity zone and a second higher air velocity zone.

In another embodiment, the method further comprises placing a secondary heat exchanger/condenser zone 135 within the housing 102, located adjacent the primary heating zone 130, wherein the secondary heating zone is located between the zoning baffle 400 and the primary heating zone 130.

Those skilled in the art to which this application relates will appreciate that other and further additions, deletions, substitutions and modifications may be made to the described embodiments.

What is claimed is:

1. A gas furnace, comprising:

a housing;

a primary heating zone located in said housing and comprising one or more heating chambers;

a blower having an exhaust opening and located adjacent said primary heating zone and positioned to force air through said primary heating zone;

a zoning baffle located between said blower and said primary heating zone, said zoning baffle comprising spaced apart baffles oriented substantially parallel with said one or more heating chambers; and wherein the one or more heating chambers comprises a plurality of heating chambers and wherein the spaced apart baffles of the zoning baffle are inboard of at least one of the plurality of heating chambers.

2. The gas furnace of claim 1, wherein said zoning baffle further includes a cross baffle that extends between said spaced apart baffles.

3. The gas furnace of claim 2, wherein said cross baffle comprises an elongated plate that is bent to form opposing plates having an angle of separation between.

4. The gas furnace of claim 2, wherein said zoning baffle comprises a first air velocity zone and a second higher air velocity zone.

5. The gas furnace of claim 2, wherein said cross baffle is oriented at an angle with respect to a horizontal position ranging from 0 degrees to about 45 degrees.

6. The gas furnace of claim 5, wherein said angle is 45 degrees.

7. The gas furnace of claim 1, wherein an angle of orientation of said spaced apart baffles from said substantially parallel orientation at an angle that ranges from 0 degrees to about 25 degrees.

8. The gas furnace of claim 7, wherein said angle is 0 degrees.

9. The gas furnace of claim 1, wherein said spaced apart baffles are separated by a distance that is less than a width of said exhaust opening.

10. The gas furnace of claim 1 further comprising a secondary heat exchanger/condenser zone located within said housing and adjacent said primary heating zone, wherein said secondary heating zone is located between said zoning baffle and said primary heating zone.

11. A method of fabricating a gas furnace, comprising:

providing a housing;

placing one or more heating chambers in said housing to form a primary heating zone;

placing a blower having an exhaust opening within said housing and adjacent said primary heating zone and positioned to force air through said primary heating zone;

placing a zoning baffle between said blower and said primary heating zone, said zoning baffle comprising spaced apart baffles oriented substantially parallel with one or more of said heating chambers; and wherein the step of placing one or more heating chambers comprises placing a plurality of heating chambers and wherein the spaced apart baffles of the zoning baffle are inboard of at least one of the plurality of heating chambers.

12. The method of claim 11, wherein placing a zoning baffle further includes placing a cross baffle between said spaced apart baffles that extends between said spaced apart baffles.

13. The method of claim 12, wherein said cross baffle comprises an elongated plate that is bent to form opposing plates having an angle of separation between.

14. The method of claim 12, wherein said placing a zoning baffle comprises creating a first air velocity zone and a second higher air velocity zone.

15. The method of claim 11, wherein said spaced apart baffles are separated by a distance that is less than a width of said exhaust opening.

16. The method of claim 11 further comprising placing a secondary heat exchanger/condenser zone within said housing and adjacent said primary heating zone, wherein said secondary heating zone is located between said zoning baffle and said primary heating zone.

17. The method of claim 11, wherein an angle of orientation of said spaced apart baffles from said substantially parallel orientation ranges from 0 degrees to about 25 degrees.

* * * * *